US007836670B2

(12) United States Patent
Cerf

(10) Patent No.: US 7,836,670 B2
(45) Date of Patent: Nov. 23, 2010

(54) PERFORATED FILM WRAPPING MACHINE

(76) Inventor: Alain Cerf, 3301 Gateway Center Blvd., Pinellas Park, FL (US) 33782

( * ) Notice: Subject to any disclaimer, the term of this patent is extended or adjusted under 35 U.S.C. 154(b) by 685 days.

(21) Appl. No.: 11/582,409

(22) Filed: Oct. 18, 2006

(65) Prior Publication Data

US 2008/0105578 A1 May 8, 2008

(51) Int. Cl.
*B65B 13/08* (2006.01)

(52) U.S. Cl. ..... 53/588; 53/399; 53/582

(58) Field of Classification Search ..... 53/461, 53/462, 464, 588, 535, 204, 206, 208–211, 53/214–216, 140, 173, 399
See application file for complete search history.

(56) References Cited

U.S. PATENT DOCUMENTS 3,792,561 A * 2/1974 Carnes ..... 53/450
3,816,969 A * 6/1974 Zimmerman et al. ..... 53/66
3,994,209 A * 11/1976 Jacob ..... 493/28
4,397,410 A * 8/1983 Schueler ..... 225/98
4,493,684 A * 1/1985 Bolton ..... 493/234
5,014,489 A * 5/1991 Terminella et al. ..... 53/51
6,379,292 B1 * 4/2002 Simhaee ..... 493/276

* cited by examiner

*Primary Examiner*—Hemant M Desai
(74) *Attorney, Agent, or Firm*—Sam Silverberg

(57) ABSTRACT

The invention is directed to means for providing a film having perforating lines wherein the perforation lines establish a length of film needed to wrap said article, means for sensing where the perforation line is located or where to make the perforation and means for separating the film at the perforation line, and means for film wrapping an article with the perforated film.

14 Claims, 1 Drawing Sheet

PERFORATED FILM WRAPPING MACHINE

FIELD OF INVENTION

This invention relates to wrapping an article with a predetermined length of film. Perforating the film at a location corresponding to the desired length predetermines the length of film. Lap seal machines use a predetermined length of film to wrap an article.

SUMMARY OF THE INVENTION

The objective of this invention is to replace the need for a shear and vacuum belt used to feed a predetermined length in a lap seal machine. This is accomplished by using means for providing a film having perforating lines wherein the perforation lines establish a length of film needed to wrap said article, means for sensing where the perforation line is located or where to make the perforation and means for separating the film at the perforation line, and means for film wrapping an article with the perforated film. These changes result in substantial economic savings.

BACKGROUND OF THE INVENTION

FIG. 1 is a conventional lap seal machine. A roll of film 2 is usually provided with printed sections spaced apart so the film can be cut without having to cut through the printed sections. Film 1 is pulled of a roll 2 by film feed rollers 5 and is fed through a dancing roll 3. From the dancing roll 3 the film goes past a sensor 4. The sensor 4 detects the location of the print or a detectable mark on the film so that a shear 6 can cut the film to a predetermined length without cutting through the printed portion of the film. From the sensor 4 the film goes to a film feed rollers 5. Feed rollers 5 push the film through the shear 6 on to vacuum belt conveyor 7. Conveyor 7 moves the film so that a flap 10 of the film is on conveyor 9. The conveyor 7 stops and waits for the next cycle. During this time the shear cuts the film 1 to predetermine length. An article moves on top of the flap on conveyor 9. Afterward a flybar 8 picks up the film from underneath the conveyor 9 to wrap the article as it moving on the conveyor with the predetermined length of film.

BRIEF DESCRIPTION OF THE INVENTION

DETAILED DESCRIPTION OF THE INVENTION

Figure 1:
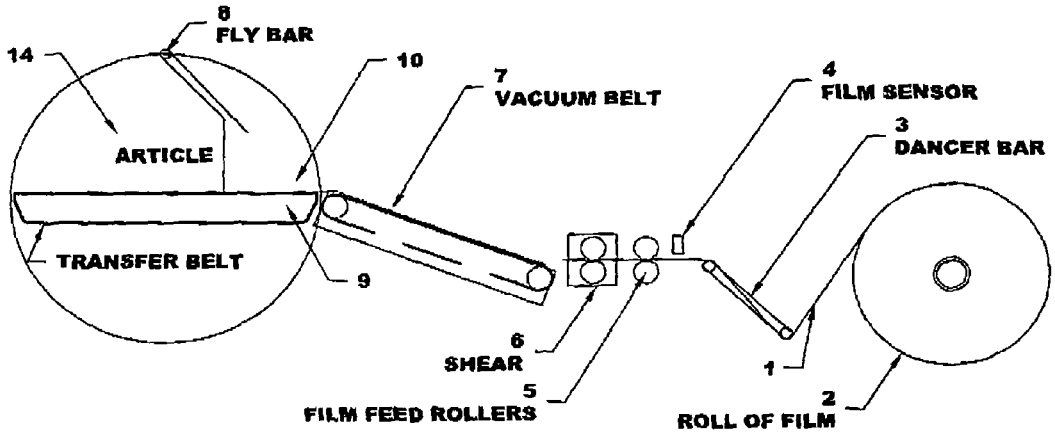
FIGURE 1 PRIOR ART
FIG. 1 shows the prior art-using a conveyor belt conveyor to feed the film.
Figure 2:
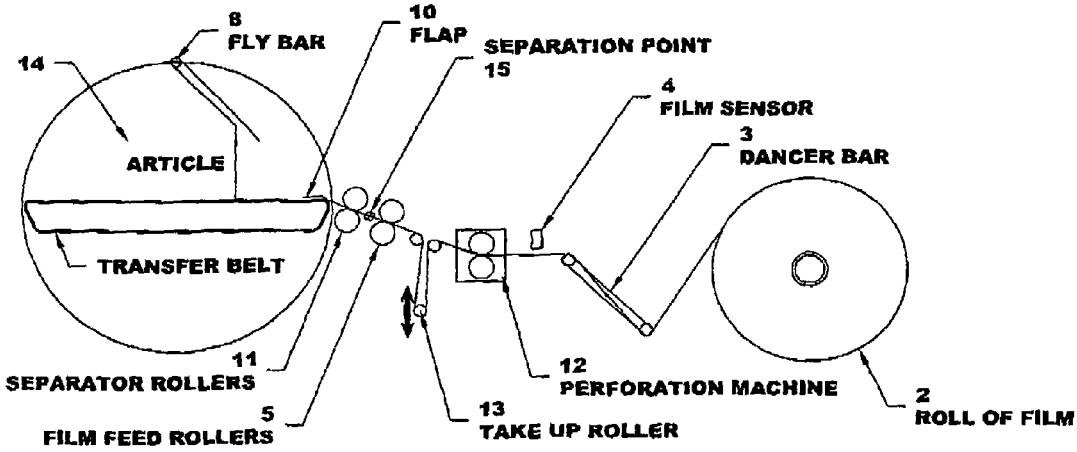
FIG. 2 shows a separation roller and a feed roller to feed the film.

FIG. 2 shows a detailed description of the invention. FIG. 2 is similar to FIG. 1 except the vacuum conveyor and the shear has been replaced by a separation rollers and a film that has perforations lines across the width of the film. The apparatus in figure two can be used with a film that already has perforation lines or where the perforation means is part of the apparatus. The film is perforated so that the film can be mechanically separated into predetermined lengths by applying a sufficient force to tear the film along a perforation line. The location of the perforation line determines the length of film to be used for wrapping an article.

The film can be provided on a roll with perforations lines corresponding to a predetermined length for wrapping an article. In the alternative a perforation machine or a shear having a serrated blade to form perforations can be inserted prior to the feed roller lines to from the perforation lines.

The means for sensing where the perforation line should be located covers two situations. First, the sensor detects a mark or indicator on a perforated film to locate the perforation line. In the alternative the sensor detects a mark or indicator on a non perforated film where the film should be perforated. Once the location of perforation is determined the location of the separation point 15 can be determined by conventional means.

In the normal operation of a film having perforation lines the separation rollers and the film feed rollers are moving at the same speed. The separation rollers 11 and feed mean rollers 5 are spaced as close possible. The film 1 is pulled off the roll 2 and a flap 10 of the film is pushed onto transfer belt. While the film is being pulled off the roll 2, a conventional sensor as used in FIG. 1 can be used to detect the location of the perforation line. Usually the film is pre marked so that the sensor can detect the location of the perforation line. The packaging bar code can be used as the mark. When the perforation line moves to a position between film feed rollers 5 and separation rollers 11, the film feed rollers slows down. The separation roller maintains its speed. This difference in speed of the rollers causes a force that mechanically separates the film along the perforation line at separation point 15. The feed rollers after the film separation continue to push the film between the separation rollers.

The means for driving the feeder rollers 5 can be a motor such as a servo motor. The separator rollers 11 can be driven by a separate motor or attached by a pulley and drive belt to the motor driving the feeder rollers. The separation roller has a free idle wheel so by inertia the separation rollers will try to maintain its original speed when the motor slows down the feeder rolls. Conventional motor controls are used to control the motors and movement of the film and the lap seal machine.

When the fly bar 8 lifts the film to wrap the article the film feed roller resumes the same speed as the separation roller and the operation is repeated to wrap the article with the predetermined length of film.

If the film is not perforated, a perforation means such as a shear with a serrated blade to form the perforations can be can be inserted before film feed roller 5. The perforation line is located on the film according to the length of film needed.

In a preferred embodiment a perforation means 12 comprising a shear with a serrated blade is used to form the perforated lines. A means to adjust the length of the film for wrapping is placed between the shear where the film is perforated and where the film is separated. The means to adjust the length of the film is a member such as a roller 13. By moving the roller 13 the film path can be changed to provide different predetermine lengths of film between the perforated line and the separation point 15.

To separate the film, there are means for stopping the feed rollers 5 when the perforation line reaches point 15. These means is usually by stopping a servo motor that drives the feed rollers causing the film to stop and the film to separate. The separation rollers will continue to spin freely on its free wheel causing the film to separate and to push the remaining film toward conveyor 9. After separation the end of the film "pushed" by the film rollers 5 enters the separation rollers 11.

This application incorporates by reference US application number not yet assigned by the same inventor filed on the same day. The title of the application is Adjustable Height Film Wrapping Machine.

The invention claimed is:

1. An apparatus for film wrapping an article comprising a conveyor for moving an article means for providing a film having a perforating line wherein the perforation line establishes a predetermined length of film needed to wrap said article, means for separating the film at the perforation line and for pushing a predetermined length of film so a flap of the predetermined film rests on the conveyor, means for film wrapping an article with the the predetermined length film and means for sensing where the perforation line should be located.

2. The apparatus according to claim 1 wherein the means for separating the film at the perforation line includes a separation rollers and a film feed rollers and means for slowing the down the speed of the film roller relative to the separation roller to mechanically separate the film at the perforation line when the perforation line is located between the film rollers and separation rollers and.

3. The apparatus according to claim 2 wherein in the means for separating the film at the perforation line includes means for resuming the speed of the film feed roller to substantially match the speed of the separation roller after the film has been separated.

4. The apparatus according to claim 1 wherein the means for separating the film at the perforation line includes separation rollers and a film feed rollers and means for stopping the speed of the film rollers while the separation rollers continue to spin freely to mechanically separate the film at the perforation line when the perforation is located between the film rollers and separation rollers.

5. The apparatus according to claim 1 wherein the means for providing a film having perforating lines includes means to perforate the film before the means for separating the film at the perforation line.

6. The apparatus according to claim 5, wherein said sensor means detects an indicator for providing a signal for where the perforation line should be made.

7. The apparatus according to claim 5 wherein the perforation means is a shear having a serrated blade.

8. The apparatus according to claim 1 wherein the apparatus for film wrapping an article is a lap seal machine.

9. The apparatus according to claim 1 wherein the means for providing a film having a perforating line includes a feed roll with a pre perforated film with printed sections and wherein the perforated lines are located between the printed sections.

10. The apparatus according to claim 9 having where in the sensing means detects an indicator that provides the location of the perforation line.

11. The apparatus according to claim 1 having a means to adjust the path length of the film and wherein the means is located before the separation means.

12. The apparatus according to claim 1 wherin the means for film wrapping an article includes a fly bar for lifting the film to wrap the article.

13. The apparatus according to claim 1 wherein the means for separating the film at the perforation line includes separation rollers and a film feed rollers and means for mechanically separating the film at the perforation line when the perforation is located between the film feed rollers and separation rollers and means for feeding the film through the separation roller after the film has been separated, then onto the conveyor.

14. The apparatus according to claim 1 wherein the means for separating and pushing the predetermined film pushes the next flap of the predetermined film on the conveyor in response to the flybar lifting the film and wrapping the article.

* * * * *